US006015057A

United States Patent [19]

Stone et al.

[11] Patent Number: 6,015,057

[45] Date of Patent: Jan. 18, 2000

[54] FLEXIBLE CONTAINER FOR FLOWABLE MATERIALS

[75] Inventors: Michael George Stone, Howden, United Kingdom; Christopher Cuddy, Cork, Ireland

[73] Assignee: Storsack Tradco Limited, East Yorkshire, United Kingdom

[21] Appl. No.: 09/077,511

[22] PCT Filed: Dec. 4, 1996

[86] PCT No.: PCT/IE96/00078

§ 371 Date: Aug. 12, 1998

§ 102(e) Date: Aug. 12, 1998

[87] PCT Pub. No.: WO97/20758

PCT Pub. Date: Jun. 12, 1997

[30] Foreign Application Priority Data

Dec. 4, 1995 [GB] United Kingdom ..... 9524766

[51] Int. Cl.[7] ..... B65D 90/00

[52] U.S. Cl. ..... 220/9.2; 383/104

[58] Field of Search ..... 220/9.2, 9.3, 9.4; 383/33, 104

[56] References Cited

U.S. PATENT DOCUMENTS

| | | | |
|---|---|---|---|
| 4,542,829 | 9/1985 | Adams | 383/104 X |
| 4,903,859 | 2/1990 | Derby et al. | 220/462 |
| 5,052,579 | 10/1991 | Boots | 220/9.3 X |
| 5,071,025 | 12/1991 | Boots | 383/104 X |
| 5,289,937 | 3/1994 | Boots | 383/104 X |
| 5,407,090 | 4/1995 | Boots | 383/104 X |

FOREIGN PATENT DOCUMENTS

| | | |
|---|---|---|
| 0 360 730 A1 | 3/1990 | European Pat. Off. . |
| 0 401 934 A1 | 12/1990 | European Pat. Off. . |
| 0 475 703 A1 | 3/1992 | European Pat. Off. . |
| 0 552 845 A1 | 7/1993 | European Pat. Off. . |
| 24 17 109 | 10/1975 | Germany . |

*Primary Examiner*—Steven Pollard

*Attorney, Agent, or Firm*—Peter F. Corless; Dike, Bronstein, Roberts & Cushman, LLP

[57] ABSTRACT

A container (1) for storage or transport of liquids comprises a flexible body (2) which is collapsible and erectable, the body having a base (18) and side walls (7, 8, 11, 12), with pockets (4) therein, and stiffining means (3) in the pockets to stiffen the flexible body (2), wherein a transverse gusset (6) is provided at each corner between adjacent side walls (7, 12, 8, 11), and a reinforcer (5) extends from the corner to the gusset, the reinforcer (5) being provided with stiffening means therein. A liner (not shown) conforms to the octogonal interior configuration of the container body. Two opposite side walls (7, 8) each have two center pockets (4*c*), and a central joint line (9) between the two center pockets (4*c*) provides a hinge line for folding of the container. Each side wall (7, 8, 11, 12), reinforcer (5) and gusset (6) may be formed of a single piece of fabric.

13 Claims, 5 Drawing Sheets

FLEXIBLE CONTAINER FOR FLOWABLE MATERIALS

TECHNICAL FIELD

The invention relates to a container of flexible material, particularly to a liquid container bag.

It is often necessary or desirable to store or transport liquids. Drums or other rigid containers are conventionally used for this purpose. Containers for liquids should be strong enough to provide for maintenance of the physical integrity of the container, thereby obviating spillage and waste, but at the same time it is often necessary for a container to be transported empty. This is often wasteful of space, and is thus costly. It is an object of the invention to seek to mitigate this disadvantage, while overcoming the disadvantages of the containers of the prior art set out below.

BACKGROUND ART

European patent No. 0 360 730 describes a flexible semi-bulk container that is suitable for use with fluidized solids, semi-solids, slurries and liquids and for shipping in less than truckload shipments where the package should have adequate stability to stand alone.

In one embodiment the container has a flexible body portion formed with side walls, a top wall and a bottom wall, access spouts in the body portion to fill and empty the body portion with fluidizedmaterial, and rigid panels associated with at least two opposing ones of the body side walls for providing rigidity sufficient to impart adequate stability to the flexible body portion to enable it to stand alone when filled with a fluidized material. The container has double layer side walls, these side walls having a space therebetween and one of the rigid panels is fixedly inserted in the space in at least two of the opposing side walls.

In another embodiment the rigid panels form a four-sided sleeve.

U.S. Pat. No. 4,622,693 describes a packaging assembly wherein a protective liner is affixed to the interior surface of a flexible bag in a manner such that the packaging assembly folds flat for storage transport and is readily converted to a substantially rectangular box for folding. It is apparent from the description that the container disclosed is intended for food products such as ribs or loin and is not suitable for use with bulk fluidized materials as evidenced by the use of light-weight paperboard etc.

U.S. Pat. No. 3,896,991 describes a flexible semi-rigid fabricating material comprising a laminate of top and bottom layers of relatively thin synthetic plastic film and a middle-layer of semi-rigid sheet material. This arrangement can be folded into a dimensional container.

While the rigid panels within the double-side wall or the sleeve described in EP 0 360 730 are said to impart sufficient rigidity to the container to allow it to stand alone when filled with a fluidized material the container does not overcome a number of perceived disadvantages.

While the rigid panels or sleeves do aid the container to retain its square or rectangular shape more closely than a container without the rigid panels would otherwise do, the container still tends to bulge out of shape. Also the corners of the container tend to become more than the nominal angle e.g. 90° in the case of a four-sided container. The container thus loses its definitive square or rectangular shape. Each such container may have an unique shape due to varying degrees of bulging. For transport purposes it is desirable that a container for fluidized material retains its square or rectangular shape in order to minimize space between containers when placed side by side in an array. This shape requirement is not fulfilled by the contents of the prior art. Furthermore it is also desirable that flexible bulk containers are stackable. At present it is extremely difficult if not impossible to arrange the containers of the prior art one on top of the other when filled with fluidized material. This is due to the nature of the contents of the container whose fluid motion causes both the container on top and that underneath to deform further when stacked. The lack of exactly matching cross-sectional shapes on the ends of the containers which abut, together with motion of the fluidized material during transport makes stacking of the containers very unstable and hazardous. In the event a container stacked as described above falls from its position it is likely to burst open spilling its contents.

DISCLOSURE OF INVENTION

In particular it is an object of the invention to provide a container which is suitable for storing or transporting fluidized material in bulk, which is collapsible to a stowable or folded configuration yet which can stand alone and in particular retains a substantially rectangular or square external profile while being filled or when full or partially full. In particular the container should not require the aid of an external stand or prop while being filled.

According to the invention there is provided a container comprising a flexible body which is collapsible and erectable, said body having a base and side walls, and stiffening means to stiffen the flexible body, characterized in that a transverse gusset is provided at each corner between adjacent side walls, and a reinforcer extends from the corner to the gusset, said reinforcer being provided with stiffening means.

Preferably the side walls have pockets therein and stiffening means are provided in at least some of the pockets. Preferably, also, each reinforcer has a pocket with a stiffening means therein.

Preferably the container has a body of flexible material e.g. a fabric such as polypropylene which is stitchable or a material which is weldable. The word "join" is used herein to cover either stitching or welding and the term "joint line" covers either a stitch line or a weld line.

Preferably the container has a liner therein, particularly a liquid impermeable liner e.g. of co-extruded plastic film such as polyethylene, conforming to the interior configuration of the body i.e. the configuration defined by the gussets bridging the corners and the parts of the side walls between the gussets. Thus in the case of a container having four side walls and four corners, the interior configuration of the body is octagonal. The liner is prevented by the gussets from extending into the corners. Therefore the liquid contents inside the liner are retained inside the interior configuration and do not occupy the corners, while the gussets hold the side walls from bulging and keep the corners square. The gussets are flexible so that the container can be folded.

In the preferred embodiment each side wall has an end pocket at each end thereof between the respective corner and a lateral joint line where the corner gusset bridging that corner is joined to the side wall, and a stiffening means is provided in each of the end pockets as well as in the reinforcer. The stiffening means in the three pockets at each corner provide the desired stability and stackability of the containers. For some types of contents it may not be necessary to provide stiffening means in the central portions of the side walls between the lateral joint lines.

In the most preferred embodiment the container has four side walls, wherein two opposite side walls each have two centre pockets between the lateral joint lines, and a central joint line between the two centre pockets provides a hinge line for folding of the container. Using a container as hereinbefore defined, it is possible to collapse the container to a substantially flat condition in the stowed (or packed) mode. The use of stitched or welded fabric to form hinges is a special feature of this invention.

Preferably the other two opposite side walls have one pocket between the lateral joint lines.

In the most preferred embodiment stiffening means are received in all of the pockets in the side walls and the pockets are closed by joining of the material defining the pockets at the top and bottom thereof.

The stiffening means may each comprise a planar member of rigid material, particularly a ply-board member. This is relatively inexpensive to make and use, but is effective at maintaining the container in the erect mode.

In a preferred embodiment the base is attached to each of the gussets at the underside thereof preferably by stitching or welding so that the base, side walls and gussets provide a continuous internal surface.

BRIEF DESCRIPTION OF DRAWINGS

A container embodying the invention is hereinafter described by way of example, with reference to the accompanying drawings.

MODES FOR CARRYING OUT THE INVENTION

Figure 1:
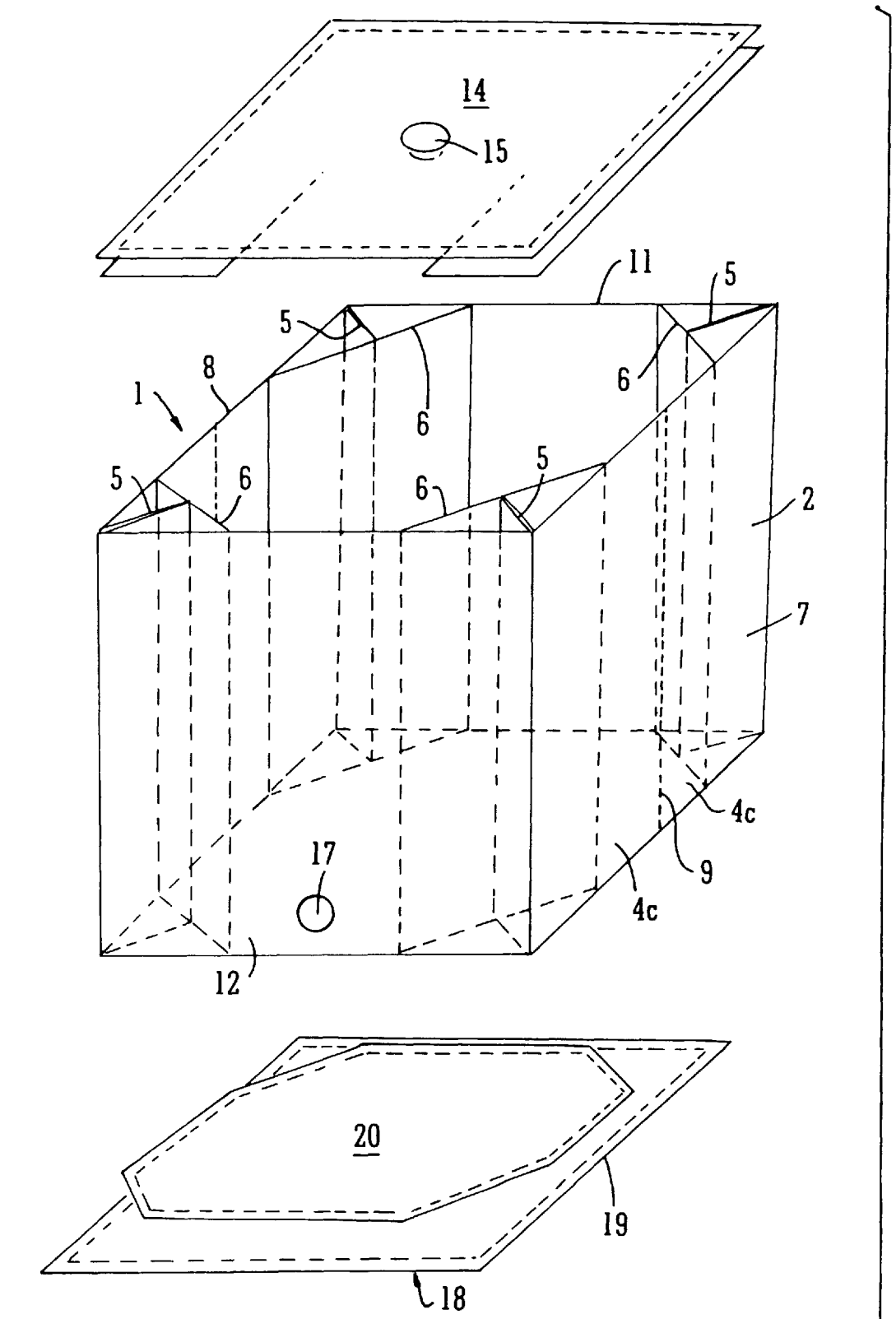
FIG. 1 is an exploded perspective view of a container in an erect condition according to the invention, showing a top, body and (optional) bottom.

Referring to the drawings, there is shown a container 1, comprising a body 2 of flexible fabric which is collapsible and erectable, and means 3 to stiffen the flexible body 2.

In the embodiment, the body 2 is made from flat or circular woven polypropylene or any other suitable material. The polypropylene is stitched to form the orthogonal-in-plan shape shown, the side walls having formed therein pockets 4. These pockets 4 are formed from single or double layers of polypropylene fabric, stitched together. There are also formed at the corners additional pockets or reinforcers 5 made of polypropylene fabric, the reinforcers 5 extending from the corners formed between adjacent sides to a transverse gusset 6. The gussets 6 are suitably made of polypropylene fabric also. Each gusset 6 bridges the corner between adjacent side walls.

Figure 2:
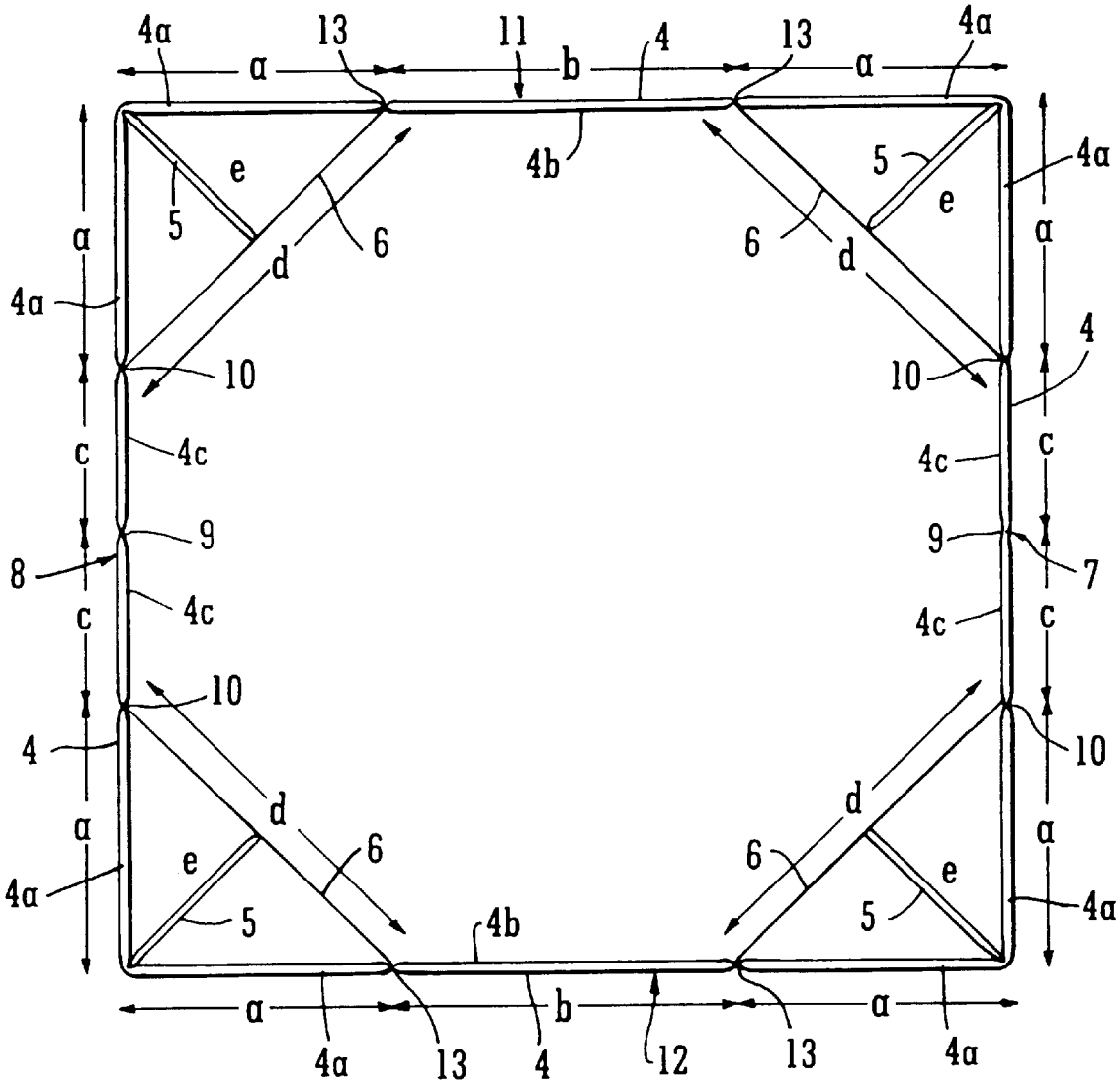
FIG. 2 is a plan view of the body with the top removed.
Figure 3:
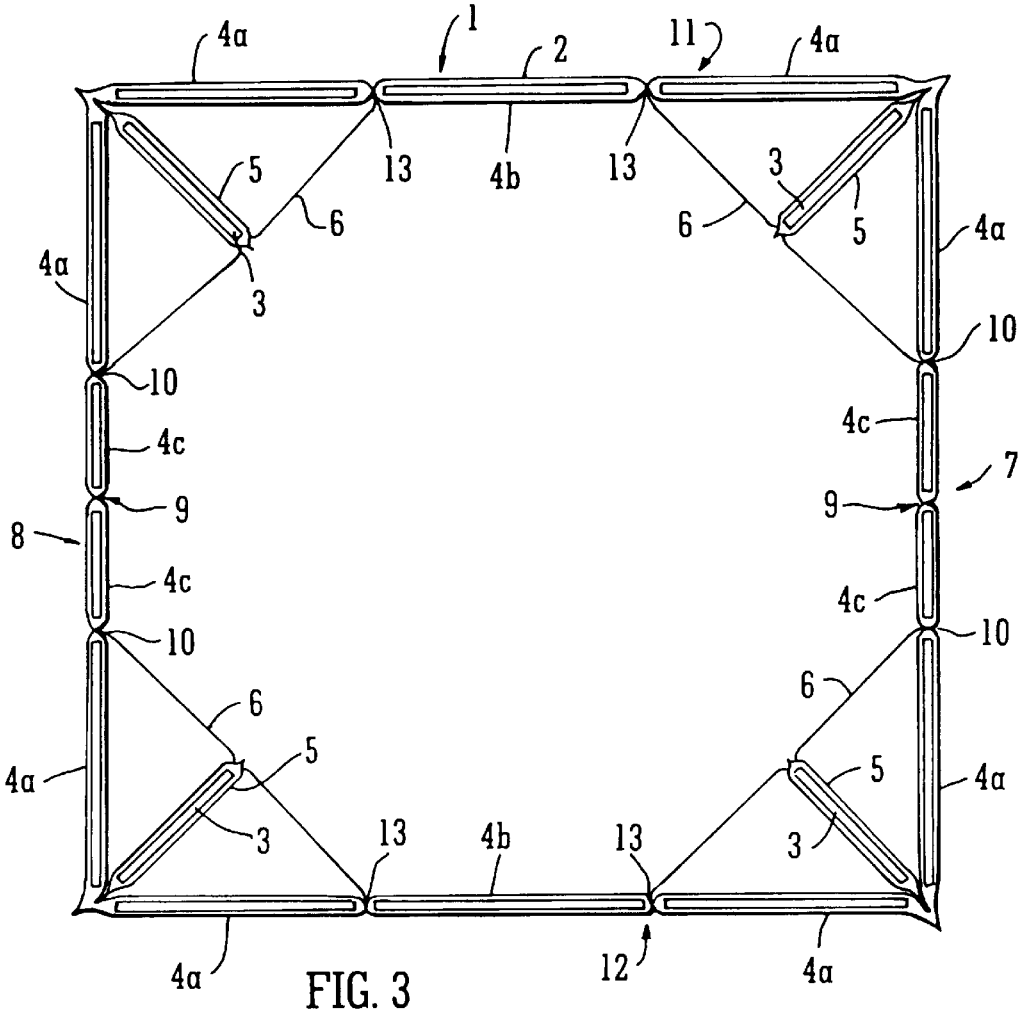
FIG. 3 is a plan view of the body with the top removed showing the means to stiffen the body inserted within pockets formed in the body.

It will be seen from FIGS. 2 and 3 that two opposite side walls 7 and 8 have a substantially central stitch line 9, there being two lateral stitch lines 10 so that those sides 7, 8 have four pockets 4*a*, 4*c*, 4*c* and 4*a*. The other two sides 11, 12 have only two stitch lines 13, thereby forming three pockets 4*a*, 4*b*, 4*a* per side. The gussets 6 are stitched to the side walls at the lateral stitch lines 10, 13. There is a reinforcer pocket 5 at each corner, stitched into the corner joint of the side walls. There are thus eighteen pockets in all and in each one there is insertable the stiffening means 3, each in the form of a planar member which in the embodiment is made of ply-board. The ply-board members 3 are of a size just to be slid into a respective pocket 4, 5 so each container 1 has eighteen members, one in each pocket. A plan view of the body shown in FIG. 3 shows a stiffening means or member 3 inserted in each pocket. In particular there are three different sizes of pocket and consequently three different sizes of stiffening members 3.

In a preferred embodiment each side wall 7, 8, 11, 12 has an end pocket 4*a* at each end thereof between the respective corner and the stitch line 10, 13 where the corner gusset 6 bridging the corner is joined to the side wall. Stiffening means 3 is provided in each of the end pockets 4*a* and in each of the reinforcers 5.

The provision of four reinforcer pockets 5 containing stiffening members 3 together with gussets 6 create an internal octagonal shape when the container is in its erected configuration. The gusset 6 is attached to reinforcer pocket 5 so as to retain pocket 5 at an angular disposition which substantially bisects the corner angle of the container i.e. arranged at approximately 45° to the side walls of the container.

The gussets 6 create an extra rigidity or tautness in each of the side walls to which it is attached. This prevents the body 2, when erect, from deviating substantially from an essentially rectangular or square configuration when empty, being filled, or full with fluidized material.

When the container is filled the gussets 6 abut the liner (not shown) so that the liner and the fluidized material contained therein do not extend into the corners. The pressure of the fluidized material also forces stiffening member 3 in reinforcer pocket 5 into the corner thus giving each corner a definitive angular (90°) shape. The gusset and corner pocket system thus uses the pressure of the fluidized material to retain the external square or rectangular shape of the flexible body 2 while imparting the internal octagonal configuration.

The container 1 thus has load-bearing sides for shape retention and which provide for stacking of a container with a similar container when full. The corner reinforcers 5 and gussets 6 provide for stacking too, by providing increased surface area (as considered horizontally) (FIG. 1) for receiving a base of a superposed container.

Figure 4A:
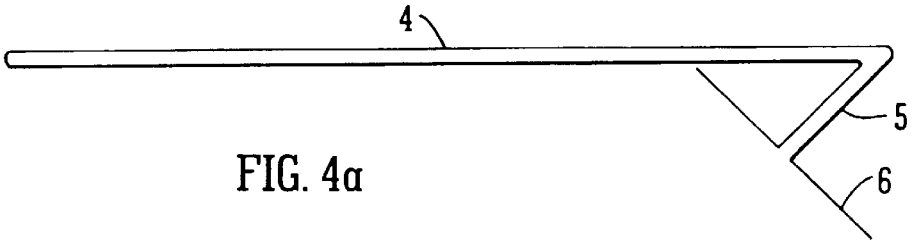
FIG. 4*a* is a plan view of one arrangement of the fabric for one side wall of the body together with a reinforcer pocket.
Figure 4B:
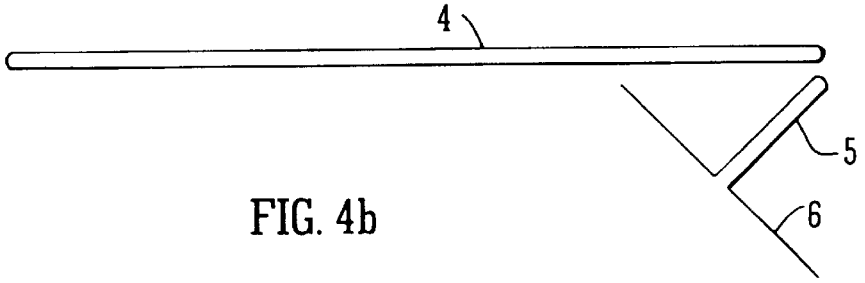
FIG. 4*b* is an alternative arrangement of the fabric for one side wall of the body together with a reinforcer pocket.

As shown in FIG. 4*a*, each side wall 4, reinforcer pocket 5, and gusset 6 may be formed of a single piece of flexible material folded so as to provide double walls. Alternatively as shown in FIG. 4*b* the side-wall is constructed of one piece of material while the reinforcer pocket 5 and gusset 6 are constructed of another. Each may however be constructed independently. The pieces of material are then joined as shown in FIG. 3.

The container 1 includes a top 14, also made of polypropylene material, which has a filling opening 15, and which is stitched to the upper edge (as viewed) of the body 2. The top 14 is formed of two layers stitched together, the lower layer (as viewed) being cut away to provide a rectangular opening for a purpose to be described.

The container has a base 18, which may be formed of a two-ply layer of fabric material stitched together to form a base pocket, which is optional. In particular base 18 may comprise a square layer of fabric material 19 and a separate upper octagonal layer of fabric material 20. The octagonal layer 20 may be stitched to the central portions of the side walls 7,8,11,12 at the lower edge thereof and to the gussets 6 also at the lower edge. This provides an internal floor surface which is integral with the flexible body 2. In particular the stitching of at least part of the layer 20 to the gussets 6 ensures that the liner cannot extend underneath the gussets 6 and hence the reinforcer pockets 5. This eliminates the possibility of the liner (when full) becoming trapped and being burst by the pressure of the stiffening members 3 present in reinforcer pockets 5 as the liner cannot extend under these pockets. Alternatively the layer of fabric material 20 may itself be another shape other than octagonal provided that it is stitched to the gussets 6. Layer 20 may extend underneath the reinforcer pockets 5 and be stitched to the base of the side walls 7,8,11,12 around the perimeter of the container.

When it is stitched to the body 2, the top 14 closes the pockets 4,5 and the container body 2. In an alternative arrangement the double side walls forming pockets 4,5 may be stitched together at top and bottom so that members 3 are permanently retained within the pockets.

A liquid impermeable liner (such as a polyethylene liner) can be inserted into the body through the rectangular opening 16 in the top 14 of the container, and glands for filling and/or emptying are secured to the apertures 15,17 of the top and front. To ensure that the liner takes up, and conforms to, the interior configuration of the container body, the liner, after insertion and connection of the glands, is inflated, then deflated suitably by collapsing the container 1 to the collapsed, flat shape. The liner thus conforms to the body shape of the container 1 in its erect mode and takes up the octagonal configuration of the interior volume of the container.

In order to collapse the container, it is only necessary to fold the body 2, inwardly at the stitch lines 9,10, thereby enabling a flat collapsed or stowed container to be achieved, with the stiffeners 3 in place, the stitch lines providing hinge lines. The members 3 located in each of the reinforcer pockets 5 do not interfere with the folding of the container 1. As the gussets 6 are constructed of flexible material these are easily folded. Pockets 5 are pivotably hinged to each of the corners and are thus foldable against the side walls of the container when the container is collapsed. In particular stitch lines on pocket 5 may provide a hinge arrangement as described above for the side-walls.

The user has merely to open the container to the shape shown in FIG. 1 by pulling out the two opposite sides about hinge lines 9, and commencing filling of liquid thereinto. The container can be placed on a pallet, after opening out. The rigidity of the stiffeners and the flexibility of the fabric ensures ready movement between the collapsed and erected conditions, the stitching and stiffeners ensuring that the unfilled yet erected container maintains its rigid shape prior to filling. This feature also ensures stackability.

It will be understood that where the material of the body is fusible, the stitching may be replaced by welding, for example heat and pressure welding or ultrasonic welding, to form hinge lines as before.

Figure 5:
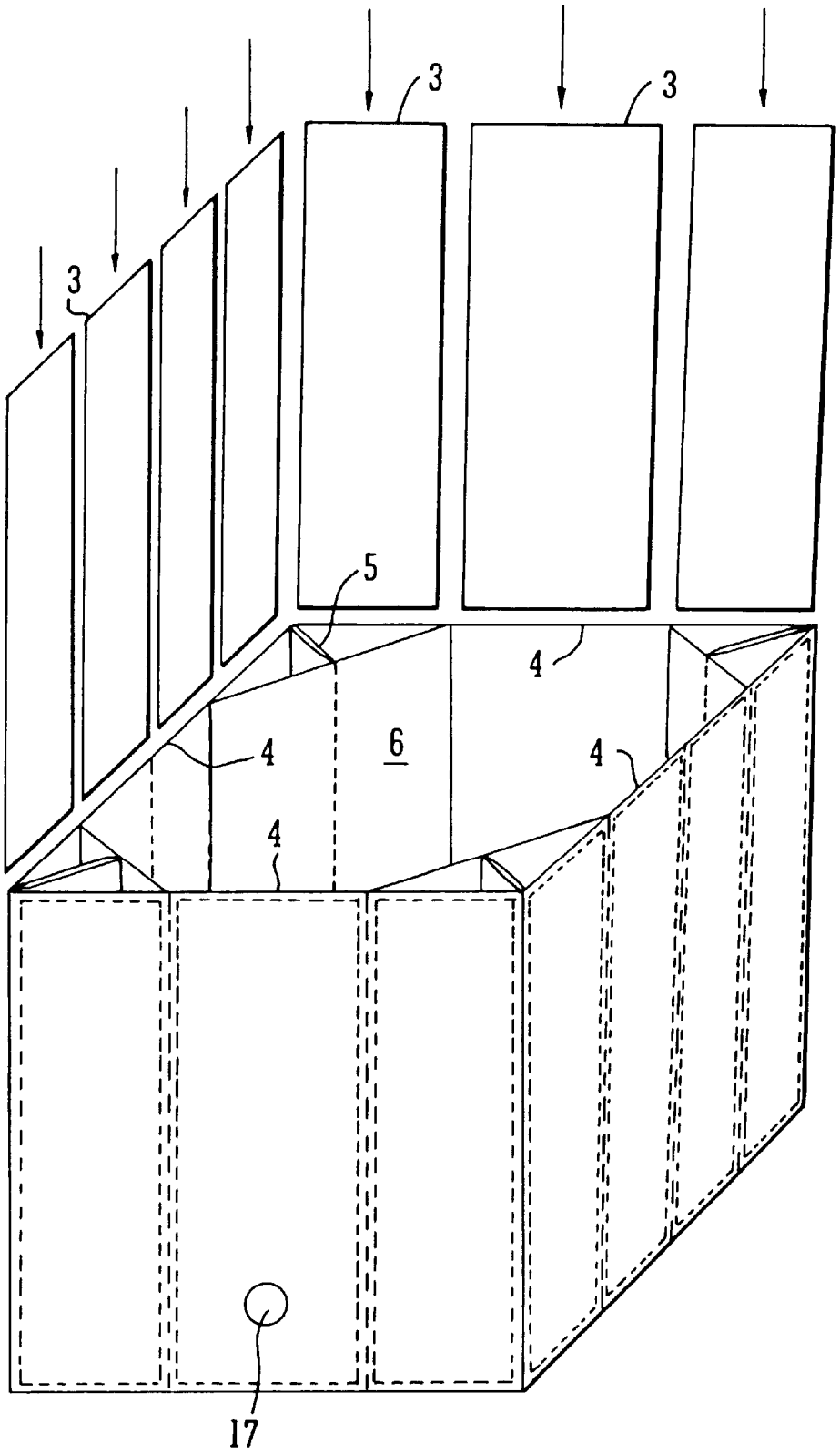
FIG. 5 is a perspective view of the body of FIG. 1 with means for stiffening the body inserted or ready to be inserted in some of the pockets formed on the body.
Figure 6:
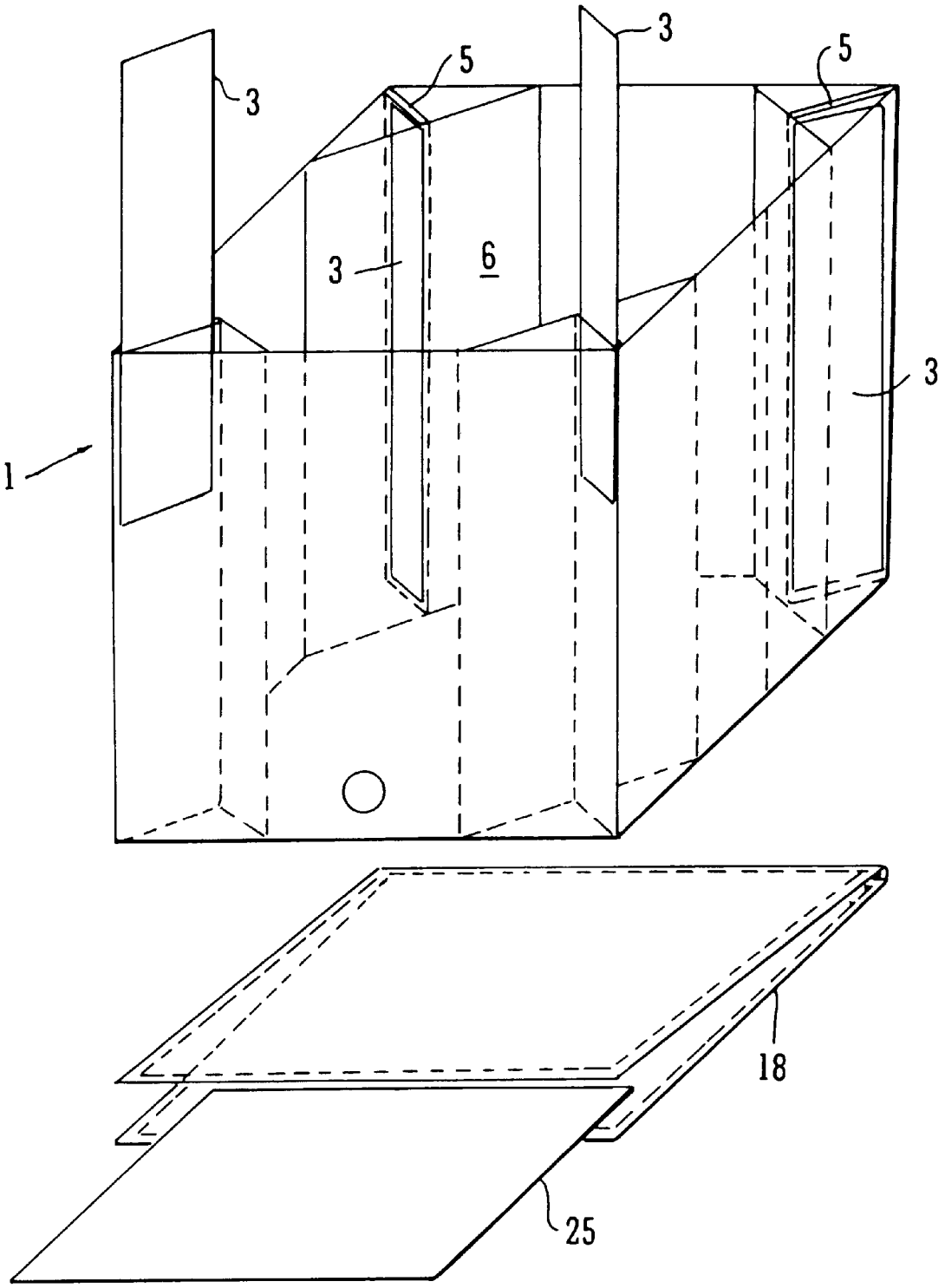
FIG. 6 is a perspective view of the body and the base of the container with stiffening means inserted or partially inserted in reinforcers provided in each internal corner of the body, and a stiffening means partially inserted in the base.

With reference to FIGS. 5 and 6 the body is shown with means 3 to stiffen the body inserted or partially inserted in pockets 4 and reinforcer pockets 5. A different size means 3 may be required for each type of pocket 4,5. In particular four identical stiffening means 3 may be provided, one in each of reinforcing pockets 5. Identical stiffening member 3 may be provided for each of the other sets of pockets e.g. eight identical means 3, one for each of pockets 4*a*; two identical means 3, one for each of pockets 4*b*; and four identical means 3, one for each of pockets 4*c*. An aperture is provided in one of the means 3 for discharge outlet 17.

As shown in FIG. 6 a planar member 25 may be inserted in base 18. Base 18 is shown as a double layer square panel, and planar member 25 is thus square. However planar member 25 may alternatively be octagonal in shape to reinforce the octagonal shape of the container 1 when the reinforcers 5 are in their extended position. Preferably planar member 25 is easily moved from the base 18 to allow easy and rapid folding of the container 1.

The filled performance of the container is achieved by the positioning of the corner reinforcers and the corner gussets which use the filled product to hold and lock the container square, or rectangular shape, with minimum shape distortion.

The nature of the container as a bulk container for storage or transport of liquids can be understood by reference to the following exemplary dimensions for FIG. 2:

| | |
|---|---|
| a (end pocket) = | 30 cm |
| b (side pocket) = | 40 cm |
| c (centre pocket, hinge side) = | 20 cm |
| d (gusset) = | 42 cm |
| e (reinforcer) = | 21 cm |

INDUSTRIAL APPLICABILITY

A container as hereinbefore described with reference to the accompanying drawings has the following advantages:

1) Fully pre-assembled and collapsible container that requires no assembly by the end user.
2) Re-usability of the container which by being able to pack flat after use saves transport costs on return journeys.
3) By shrouding the liquid liner, can be used for UN hazardous goods.
4) Adding four lifting loops (as in EP 0 475 703 A1, FIGS. 21–22) will enable top handling of container and product.
5) Square or rectangular filled pack, free standing.
6) Stackable without a supporting frame.
7) Rigidity during transportation without external supports.
8) Adding a base board in the base and/or a slip sheet will save on cost of a pallet.
9) Can be used for
   a) Top handling;
   b) Use without a pallet or with Slip Sheets;
   c) UN hazardous goods.

We claim:

1. A container comprising a flexible body which is collapsible and erectable, said body having a base and side walls, and stiffening means to stiffen the flexible body, and a transverse gusset is provided at each corner between adjacent side walls, and a reinforcer extends from the corner to the gusset, said reinforcer being provided with stiffening means.

2. A container according to claim 1 wherein the side walls have pockets therein and stiffening means are provided in at least some of the pockets.

3. A container according to claim 1 or 2 wherein each reinforcer has a pocket with a stiffening means therein.

4. A container according to claim 1 having a liner therein conforming to the interior configuration of the container body.

5. A container according to claim 1 wherein each side wall has an end pocket at each end thereof between the respective corner and a lateral joint line where the corner gusset bridging the corner is joined to the side wall, and a stiffening means is provided in each of the end pockets as well as in the reinforcer.

6. A container according to claim 5 having four side walls, wherein two opposite walls each have two centre pockets between the lateral joint lines, and a central joint line between the two centre pockets, and a central joint line between the two centre pockets provides a hinge line for folding of the container.

7. A container according to claim 6 wherein the other two opposite side walls have one pocket between the lateral joint lines.

8. A container according to claim 2 wherein the pockets are formed by stitching.

9. A container according to claim 2 wherein the body comprises a weldable material and the pockets are formed by welding.

10. A container according to claim 1 wherein the stiffening means each comprises a planar member.

11. A container according to claim 10 wherein the planar member comprises ply-board.

12. A container according to claim 1 wherein the base is attached to each of the gussets at the underside thereof.

13. A container according to claim 1 wherein each side wall, reinforcer and gusset is formed of a single piece of flexible material folded so as to provide double walls.

* * * * *